US005277635A

United States Patent [19]

Gillis

[11] Patent Number: 5,277,635

[45] Date of Patent: Jan. 11, 1994

[54] WATER SKIBOARD WITH ROTATABLE BINDING

[75] Inventor: Donald B. Gillis, Lake Stevens, Wash.

[73] Assignee: Connelly Skis, Inc., Lynwood, Wash.

[21] Appl. No.: 810,817

[22] Filed: Dec. 19, 1991

[51] Int. Cl.[5] ..... A63C 9/08

[52] U.S. Cl. ..... 441/74; 441/68

[58] Field of Search ..... 280/618, 617, 607, 613, 280/633; 441/65, 68, 67, 70, 74, 75; 114/39.2; 248/503.1; 24/70.5K

[56] References Cited

U.S. PATENT DOCUMENTS

| | | | |
|---|---|---|---|
| 3,662,435 | 5/1972 | Allsop | 24/70 SK |
| 4,846,744 | 7/1989 | Love | 441/74 |
| 4,850,916 | 7/1989 | Phillips | 441/74 |
| 4,891,027 | 1/1990 | Plunkett | 441/68 |
| 4,969,655 | 11/1990 | Katz | 441/74 |

*Primary Examiner*—Robert J. Oberleitner

*Assistant Examiner*—Clifford T. Bartz

*Attorney, Agent, or Firm*—Christensen, O'Connor, Johnson & Kindness

[57] ABSTRACT

A skiboard system comprising a skiboard having a channel extending along a portion of the length thereof and two bindings secured, via the channel, to the skiboard. The bindings are design to be rotated between a locked starting position, where the long axes of the bindings extend parallel to the long axis of the skiboard, and a locked skiing position, where the long axes of the bindings extend transversely to the long axis of the skiboard. After the bindings have been rotated to a selected position, the bindings are secured in place via a locking mechanism that is operated by movement of a pivotally mounted handle. In addition, the bindings include a resilient front strap assembly and a resilient heel support for securing the user's feet to the binding while at the same time permitting a user to quickly and easily remove his or her feet from the bindings in the event of a fall.

5 Claims, 4 Drawing Sheets

WATER SKIBOARD WITH ROTATABLE BINDING

FIELD OF THE INVENTION

The present invention pertains to water skiboards and bindings used therewith, and more particularly to a water skiboard binding system including a rotatable binding.

BACKGROUND OF THE INVENTION

Water skiboards ("skiboards") are a relatively new recreational product related to slalom water skis. A skiboard is typically, although not always, wider and shorter than a slalom water ski that a person of given weight and ability would use. In addition, the bindings on a skiboard are mounted such that the user's feet are positioned side-by-side, at an angle to the long dimension of the skiboard. By contrast, with a slalom water ski, the bindings are positioned one in front of the other, so that the skier's feet extend parallel to the long dimension of the ski.

Because the bindings on known skiboards are mounted at an angle to the long dimension thereof, it tends to be difficult for a skiboard user to get up from a starting position in the water to the standing position the user assumes when the skiboard is pulled across the surface of the water. Currently, a skiboard user must either (a) position the skiboard so that its long axis is parallel to the direction of travel of the power boat used to pull the skiboard and user, and then position his or her body at an angle to the direction of travel, or (b) position his or her body so as to face the boat and position the skiboard at an angle to the direction of travel. In either case, it tends to be difficult to get started, with the result that less athletic persons or persons lacking the time to perfect using a skiboard often give up before attaining proficiency. In some cases, the problems associated with "getting up" on a skiboard are enough to prevent certain individuals from even trying to ski with a skiboard. Such problems do not exist with a slalom water ski because the bindings are mounted such that the long axis of the ski and the front of the user's body may be positioned in the direction of travel of the power boat used to pull the skiboard and user.

In the field of snowboarding, bindings have been developed that permit a snowboard user to adjust the rotational orientation of the bindings on the snowboard. One such binding is sold by the French company Look. The Look binding includes (1) a circular plate that is attached to the snowboard via fasteners, e.g., screws, engaged with the snowboard and (2) a footbed having a central aperture for rotatably receiving the circular plate. A lock assembly is provided for locking the footbed in predetermined rotational position with respect to the circular plate. A housing, including one or more fasteners, is attached to the footbed for securing a user's boot to the footbed such that the boot cannot be pulled free of the footbed except when the fasteners are released. Often, a user adjusts the orientation of the binding at the beginning of the season, and then no further adjustments are made.

Another snowboard with rotatably adjustable bindings is disclosed in U.S. Pat. No. 4,964,649 to Chamberlin. The Chamberlin binding is designed to permit a user to rotate the binding slightly from a preselected position by appropriate application of torque applied via the user's boots to the binding. When such torque is no longer applied, elastomeric structure in the binding causes the binding to return to the preselected position. The Chamberlin binding is not designed to permit a user to rotate the binding to a selected position during use of the associated snowboard and then lock the binding in place.

An adjustable binding designed for use with a water skiboard is disclosed in Harris U.S. Pat. No. 4,871,337. The Harris binding includes a foot plate that rests on the top surface of the skiboard and a two-layer strap attached to the plate for securing a user's foot to the plate. The plate is attached by two clamp assemblies to an elongated channel extending lengthwise of the skiboard. The clamp assemblies permit the user to secure the bindings at selected locations along the length of the channel. The clamp assemblies include set screws extending through arcuate slots in the foot plates to allow limited adjustment of the angular positions of the foot plates relative to the length of the skiboard. The range of rotation of each foot plate is limited to the normal riding positions, i.e., in the most forward rotated position of each foot plate it extends at an angle of about 45° to the length of the board. Furthermore, two set screws must be loosened before the foot plate can be repositioned, and must be tightened to secure the foot plate in place, and, when the clamp assemblies are loosened to permit the bindings to be rotated to a new position, the bindings are also free to move along the length of the skiboard. Such longitudinal movement of the bindings is undesirable when only rotational repositioning is desired. The Harris construction is not adapted for convenient adjustment of the rotational position of water skiboard bindings during use of the skiboard.

SUMMARY OF THE INVENTION

The present invention is a skiboard system comprising a skiboard and a pair of rotatable bindings designed for use therewith. The skiboard has a top surface and an attachment member, e.g., a C-shaped channel opening through the top surface of the skiboard and extending along at least a portion of the length of the skiboard. Each of the bindings includes a base and a retention assembly coupled to the base for securing a user's bare foot in firm engagement with the base and for permitting the foot to be disengaged from the base solely by pulling the foot away from the base with a predetermined force. Each of the bindings also includes a mounting assembly coupled to the base and designed to be releasably secured to the attachment member at a selected location along the length thereof, for attaching the base to the skiboard so as to permit the base to be freely rotated about an axis intersecting the base and extending substantially normal to the top surface of the skiboard while preventing the base from moving along the length of the skiboard. Additionally, each of the bindings includes a lock assembly attached to the mounting assembly and including an actuation member movable between locked and unlocked positions. The lock assembly is designed to secure the base to the mounting assembly in a selected rotational position with respect to the axis extending normal to the top surface of the skiboard when the actuation member is in the locked position and to permit the base to be rotated relative to the mounting assembly about the axis when the actuation member is in the unlocked position. The lock assembly is designed to be quickly and easily operated during use of the skiboard system.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
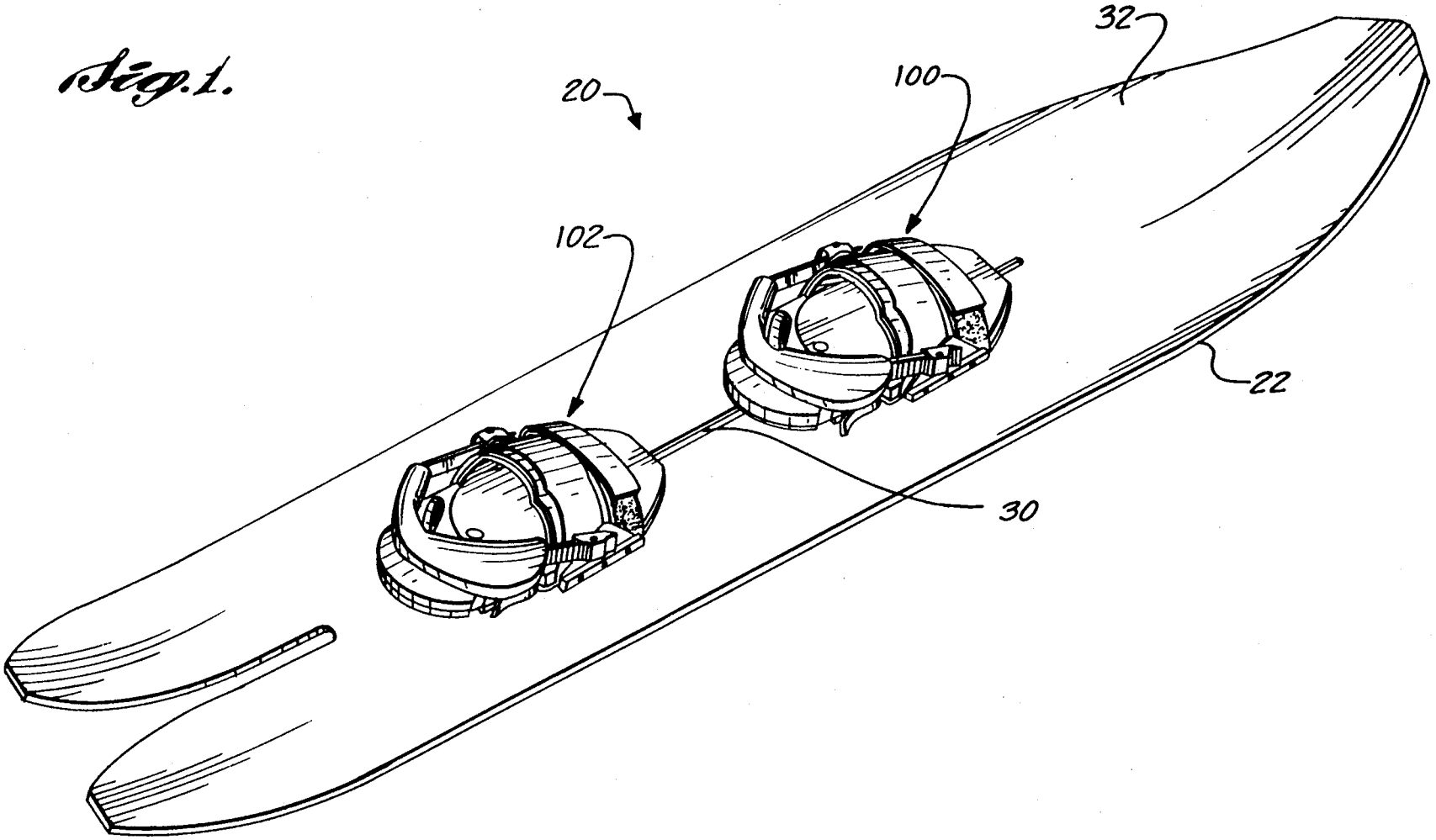
FIG. 1 is a perspective view of the skiboard system of the present invention including a skiboard and bindings selectively rotatable relative thereto.

Referring to FIG. 1, the present invention is a skiboard system 20 comprising a water skiboard 22 and rotatable bindings 100 and 102.

Skiboard 22 is adapted to ride on the water, having a similar size, shape and construction to that of known skiboards. Skiboard 22 includes an elongate channel 30 extending along at least a portion of the length of the skiboard. Channel 30 is preferably centered relative to the width of skiboard 22. Channel 30 preferably has a C-shaped cross-sectional configuration, with the open portion of the "C" opening through the top surface 32 of skiboard 22. In one embodiment of the invention, channel 30 has a depth of about 1 cm and a width, at top surface 32 of skiboard 22, of about 1 cm. This channel 30 also has an interior width of about 2 cm, as measured at its greatest interior width dimension. Other channel configurations may also be satisfactorily employed.

Bindings 100 and 102 are identical. Thus, the following description of binding 100 also applies to binding 102.

Figure 2:
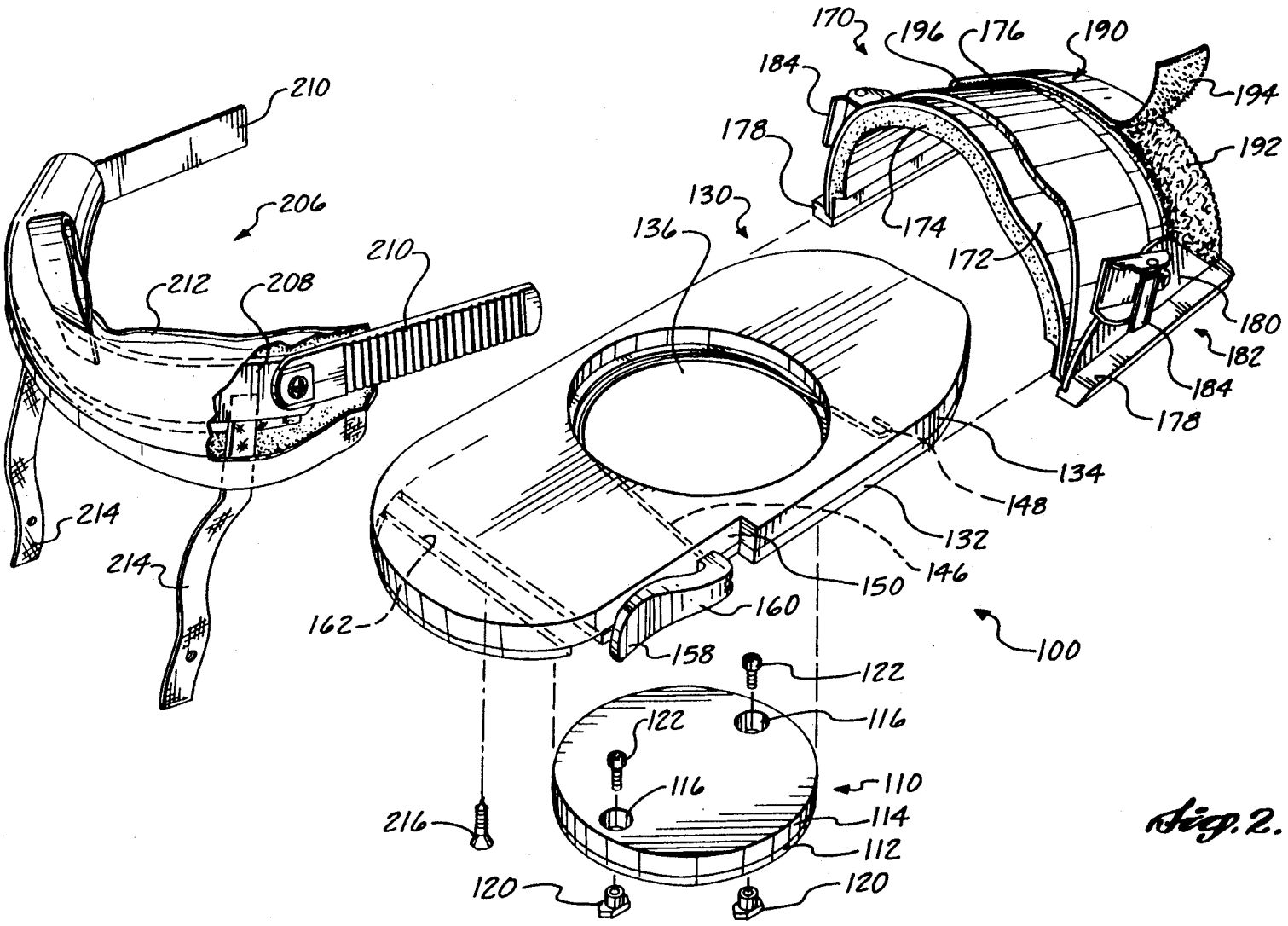
FIG. 2 is an exploded perspective view of one of the bindings of the skiboard system illustrated in FIG. 1.
Figure 3:
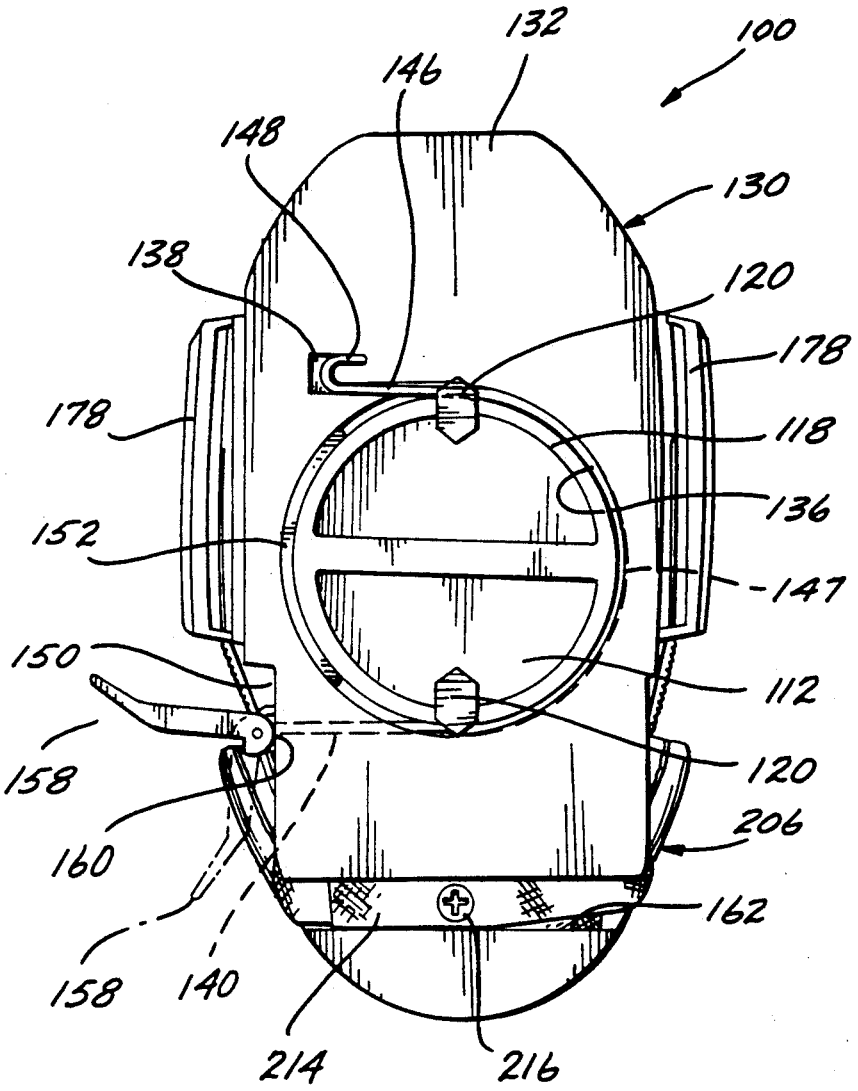
FIG. 3 is a bottom view of one of the bindings of the skiboard system illustrated in FIG. 1.

As best seen in FIG. 2, binding baseplate 100 comprises a circular baseplate 110 made up of a bottom portion 112 and an upper portion 114. Bottom portion 112 is preferably made from a rigid, noncompressible material such as glass-filled nylon. Upper portion 114 is preferably made from a soft resilient material such as EVA closed-cell foam. Bottom portion 112 and upper portion 114 have identical diameters at their mating plane and are bonded together using an appropriate adhesive or other fastener. In one embodiment of binding 100, baseplate 110 has a diameter of about 12 cm. A pair of diametrically opposed, countersunk holes 116 are provided adjacent the periphery of circular plate 110. As illustrated in FIG. 3, bottom portion 112 includes a downward projecting annular lip 118. The outside diameter of lip 118 is somewhat less than that of the upper part of portion 112 from which the lip extends.

Returning to FIG. 2, circular plate 110 may be secured to skiboard 22 at a selected location along the length of channel 30 using screws 122 extending through the holes 116 and t nuts 120 received in the central channel of the skiboard. The heads of t nuts 120 are sized and configured so that in one position the heads may be inserted in the skiboard channel and, in a second position, rotatably disposed 90° from the first position, the heads will bridge across the top opening of the channel so as to prevent the nuts from being removed therefrom. The circular plate 110 is firmly secured to the skiboard at a selected location along the length of the channel by tightening the screws 122.

Binding 100 also includes a footbed 130. Like the circular baseplate 110, footbed 130 features a two-part construction consisting of bottom layer 132 and upper layer 134. In one embodiment of the present invention, footbed 130 is sized to support a wide range of foot sizes, with the footbed having a width of about 13 cm and a length of about 29 cm. Bottom layer 132 is typically made from the same material used to make bottom portion 112 of circular plate 110, i.e., a rigid, noncompressible material such as glass-filled nylon. Similarly, upper layer 134 is typically made from the same material as upper portion 114 of circular plate 110, e.g., EVA closed-cell foam. An appropriate adhesive or fastener is used to secure upper layer 134 to bottom layer 132.

The interconnection of the footbed 130 to the circular plate 110 is essentially the same as the system used in the snowboard manufactured by the French Company Look referred to in the "Background of the Invention" section above. Footbed 130 includes a circular aperture 136 extending therethrough. Aperture 136 is sized to receive circular plate 110 with a close-sliding rotatable fit. As best illustrated in FIG. 3, bottom layer 132 includes a groove 138 opening out to the bottom surface of the bottom layer, with one end of the groove having a U-shaped configuration and the other end of the groove intersecting and terminating at aperture 136. Bottom layer 132 also includes a bore 140 (FIG. 3) coupling the circular aperture 136 with outer edge 150 of the bottom layer. A wire or band 146 having a curved central portion 147 (FIG. 3) is received in circular aperture 136. Wire 146 includes a hooked end 148 positioned in the U-shaped portion of groove 138 and a straight end positioned in bore 140 and sized to extend beyond side edge 150 of bottom layer 132.

When circular plate 110 is inserted in aperture 136, wire 146 will engage and wrap around a portion of the projecting annular lip 118, as best illustrated in FIG. 3.

Footbed 130 also includes a curved friction plate 152 secured to the peripheral wall of aperture 136 opposite the portion of projecting annular section 118 along which the curved portion 147 of wire 146 extends as in the look snowboard constructions, a handle 158 having a curved cam surface 160 is pivotally attached to the end of wire 146 that projects outwardly of edge 150 of bottom layer 132 so as to be movable between a locked position (illustrated in phantom in FIG. 3) and an unlocked position (illustrated in solid lines in FIG. 3). Preferably, handle 158 has a length of at least about 4 cm so as to provide sufficient mechanical advantage to permit a user to move that handle easily between the locked and unlocked positions, as described in more detail hereinafter. Plate 152 is sized to slidingly engage annular section 118 when handle 158 is in the unlocked position and to tightly engage section 118 when handle 158 is in the locked position, as discussed in more detail hereinafter.

Bottom layer 132 includes a groove 162 (FIG. 3) that extends across the width of the rear portion of the bottom layer and opens outwardly to the bottom surface thereof.

As best illustrated in FIG. 2, binding 100 includes a front portion 170 for releasably securing the front portion of a user's foot to footbed 130. Front portion 170 includes a resilient strap or toe piece 172 sized to extend from one edge of footbed 130, across the arch and front portion of a user's foot, to an opposite side of the footbed. In one embodiment of the invention, resilient strap 172 is made from a neoprene sheet having a width of about 11 cm and a thickness of about 4 millimeters. Preferably, resilient strap 172 is lined with a layer of cushioning material 174 made, for instance, from closed-cell foam. A layer of elastic material 176 extends over, but is not attached to resilient strap 172. Layer 176 has an elasticity somewhat less than that of resilient strap 172.

The opposite side edges of resilient strap 172, cushioning layer 174 and resilient layer 176 are secured via fasteners (not shown), e.g., screws, to elongate members 178. Such fasteners extend through the elongate members 178, the bottom edges of straps and layers 172–176 and into bottom layer 132 of footbed 130.

A rigid plate 180 is interposed between elongate member 178 and the bottom edges of straps and layers 172–176 and is secured to bottom layer 132 via the fasteners used to secure straps and layers 172–176 to the bottom layer. A quick-release lock mechanism 182 is attached to each plate 180, with each lock mechanism including a pivotally mounted latch 184. The operation of lock mechanism 182 is described in more detail in connection with the description of heel support 206.

Front portion 170 also includes a two-part strap 190 made from a relatively inflexible material, e.g., nylon webbing. Strap 190 includes a first end portion 192, one surface of which is covered with loop fastening material, and a second or free end portion 194 having hook fastening material covering one surface thereof. Portion 192 extends across, but is not secured to, the front portion of resilient strap 172. One end of portion 192 is secured to the edge of footbed 130 via member 178 and the fasteners extending therethrough. The opposite end of portion 192 extends through a rigid oval ring member 196. Ring member 196 is attached to the opposite side of footbed 130 via a strap (not shown) secured via the associated elongate member 178 to bottom layer 132. Portion 194 extends from the ring member back across portion 192 such that the hook material on portion 194 engages the loop material on portion 192, thereby releasably securing portion 192 to portion 194.

Binding 100 additionally comprises heel support 206 for urging the back portion of a user's foot toward front portion 170 and for preventing the back portion from rising up from footbed 130. Heel support 206 comprises a heel strap 208 made from a resilient material such as neoprene. A rigid engagement strap 210 is attached to each end of heel strap 208. Each strap 210 is designed to be received in and releasably secured to an associated lock mechanism 182, as discussed in greater detail hereinafter. Although the specific design of strap 210 and locking mechanism 182 may vary, these elements should be constructed so as to permit the ends of heel strap 208 to be releasably secured to, and selectively positioned with respect to, front portion 170. Strap 210 and locking mechanism 182 may, for example, be designed in accordance with the invention disclosed in U.S. Pat. No. 3,662,435.

Preferably, heel strap 208 and a portion of that end of each strap 210 secured to the heel strap is received within a fabric sleeve 212. Sleeve 212, and hence heel strap 208 received therein, is attached in spaced relation to bottom layer 132 of footbed 130 via straps 214. Straps 214 are received in groove 162 in bottom layer 132 and are secured in place via screw 216. The length of straps 214 is selected so that when heel support 206 is pulled up such that the straps are fully tensioned, heel strap 208 will be positioned just above the heel of, and will extend across the Achilles tendon of, a foot properly positioned on footbed 130.

Figure 4:
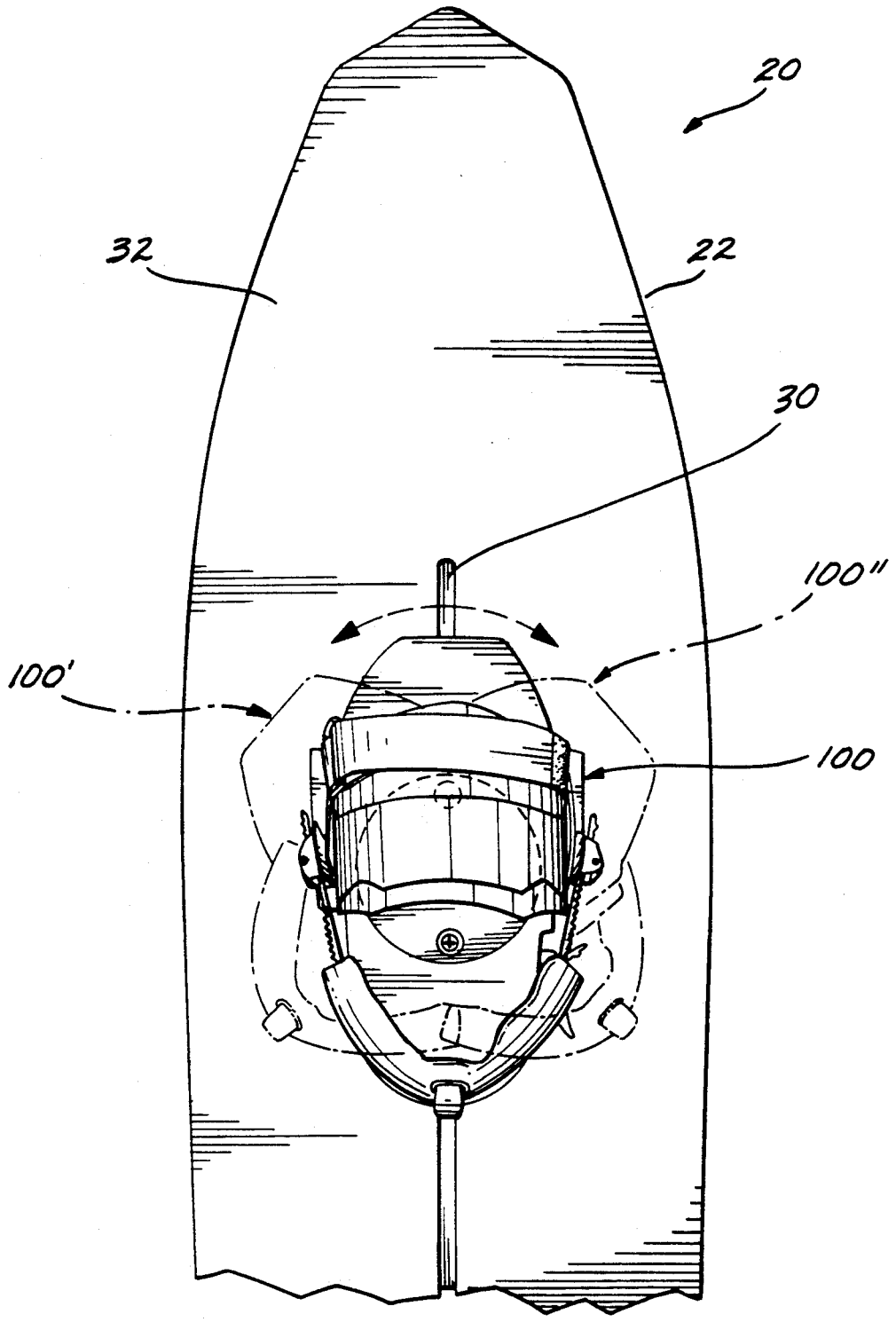
FIG. 4 is a top view of the front portion of the skiboard system illustrated in FIG. 1, with the binding being illustrated in solid lines with its long axis extending parallel to the long axis of the skiboard and with the binding being illustrated in phantom in different orientations.

In connection with the following discussion of the use and operation of skiboard system 20, reference should be made to FIGS. 1–4. Assuming bindings 100 and 102 are fully assembled, as illustrated in FIGS. 1 and 4, bindings 100 and 102 are first secured at selected locations along the length of channel 30 by positioning bindings 100 and 102, and by adjusting the associated nuts 120, such that the heads of the nuts may be inserted into channel 30. Then, nuts 120 are rotated 90° and screws 122 are tightened so as to draw the heads of the nuts upwardly into tight frictional engagement with the upper walls of channel 30, thereby securing the circular plates 110 of bindings 100 and 102 to skiboard 22. The precise placement of bindings 100 and 102 along the length of skiboard 22 will vary as a function of the size, ability, and stance preference of the user. Often, the longitudinal placement of bindings 100 and 102 is selected at the beginning of the season and has not changed for the remainder of the season.

Prior to using skiboard system 20 on the water, a user next adjusts front portion 170 and heel support 206 on each of the bindings 100 and 102 so that the user's feet are snugly, yet releasably, secured to the footbed of the bindings. To perform this adjustment, the user inserts his or her foot under front portion 170, pulls the hook portion 194 of strap 190 away from loop portion 192 and tightens strap 190 an appropriate amount by pulling on hook portion 194. Then, to lock strap 190 at the selected level of tightness, hook portion 194 is pressed against loop portion 192. When properly adjusted, strap 190 limits the elastic expansion of resilient strap 172, thereby limiting the forward movement of the foot within the binding 100 or 102. Elastic layer 176, which, as noted above, is somewhat less elastic than strap 172. further limits forward and upward movement of a foot positioned under front portion 170. Typically, the user has bare feet, although in some instances a user may wear a thin "soft bootie" or other thin, flexible sock-like foot apparel.

Next, heel support 206 is moved toward or away from front portion 170, based on the size of the user's foot, so that the foot is urged forwardly against front portion 170. Such adjustment of heel support 206 is achieved by releasing the latches 184 of lock mechanisms 182 and then moving the associated straps 210 received within the locking mechanism back or forth, as required. When appropriate placement is achieved, the latch 184 is released, thereby locking the straps 210 in selected position with respect to the locking mechanism.

Bindings 100 and 102 are then rotatably adjusted so that the long axis of the bindings extend parallel to the long axis of skiboard 22, as illustrated in FIG. 1. Such adjustment is achieved by first moving handle 158 to the unlocked position, as shown in solid line in FIG. 3. Such adjustment of handle 158 reduces the length of the end of wire 146 that projects outwardly from bore 140 past edge 150 of bottom layer 132. By reducing the length of wire 146 projecting outwardly past edge 150, the force with which wire 146 drives projecting annular section 118 against friction plate 152 is reduced. Such reduction in force, permits circular plate 110 to rotate relatively freely within aperture 136. In this regard, wire 146 is sized so that when handle 158 is in the locked position illustrated in phantom view in FIG. 3, thereby increasing the length of wire 146 projecting outwardly past edge 150, the length of wire surrounding projecting annular section 118 is reduced an amount sufficient to drive annular section 118 against friction plate 152 with a force sufficient to prevent the annular section, and, hence, circular plate 110, from rotating within aperture 136. Cam surface 160 on handle 158 provides a mechanical advantage that facilitates the tensioning and untensioning of wire 146. Assuming bindings 100 and 102 are positioned in the manner illustrated in FIG. 1, handle 158 on each of the bindings is then moved to the locked position, thereby preventing the bindings from rotating with respect to skiboard 22.

Upon completion of the adjustment and placement of bindings 100 and 102, as described above, skiboard system 20 is ready for use on water. A user starts skiing with skiboard system 20 in substantially the same way a skier starts water skiing with a slalom water ski. Thus, with skiboard system 20, a user positions the ski so that its long axis extends parallel to the direction of travel of the power boat used to pull the skiboard, with the user's body being aligned with and facing the power boat. This starting position is significantly different from the starting position a user assumes when starting to ski with a conventional skiboard in which the bindings are rigidly attached at an angle to the long axis of the skiboard. As noted above, in the latter case, the user either aligns the skiboard with the direction of travel of the boat and positions his or her body off to one side, or positions his or her body in alignment with the path of the boat and positions the skiboard at an angle to the direction of travel of the boat.

After the power boat has pulled the skiboard and user out of the water such that the skiboard is traveling along the top surface of the water, the user then adjusts bindings 100 and 102 so that the long axes of the bindings extend transversely to the long axis of skiboard 22, i.e., in a binding position similar to that used on prior art skiboards. The user achieves such adjustment by bending down and manually moving handle 158 on one of bindings 100 and 102 to the unlocked position, rotating the binding with his or her foot to the desired transversely extending position, and then moving the handle back to the locked position, thereby securing the binding in place. A similar adjustment is then made to the other binding. As a consequence of the length of handle 158, the use of cam surface 160 on the handle, and other design features of the various elements for releasably securing circular plate 110 to footbed 130, discussed above, a user can easily and quickly move handle 158 between the locked and unlocked positions.

Such adjustment of bindings 100 and 102 is illustrated in FIG. 4 with respect to binding 100. In the starting position, binding 100 is oriented in the position illustrated in solid view. After "getting up," a user preferring a "right foot first" stance would then adjust binding 100 to the positioned illustrated in phantom view and identified by 100'. A user preferring a "left foot first" stance would move binding 100 to the position illustrated in phantom view and identified by 100''.

An important advantage of skiboard system 20 is that it permits an inexperienced and/or relatively unathletic user to use a skiboard without extensive practice and instruction. It is believed that a relatively large class of potential skiboard users have been and, but for the present invention, would be deterred from enjoying the sport of skiboarding.

Skiboard system 20 uniquely permits a user to rotatably position bindings 100 and 102 as desired during use, while at the same time permitting the user to quickly and easily remove his or her feet from the bindings in the event of a fall. Due to the relatively resilient nature of strap 172, cushioning layer 174, and outer elastic layer 176, as well as the use of elastic heel strap 208 in heel support 206, the user can easily free his or her foot from footbed 130 without the need to operate locking mechanisms 182. Thus, in the event of a fall, a user merely pulls his or her feet away from bindings 100 and 102 with a force adequate to stretch (a) strap 172, layer 174, and layer 176 and/or (b) heel strap 208 such that the feet are no longer held in place by front portion 170 and heel support 206. A typical skiboard user can easily generate such force, although in some instances the user may also want to pull heel support 206 downwardly off his or her ankle.

Certain changes may be made in the above skiboard system without departing from the scope of the invention herein involved. In this regard, although bindings 100 and 102 are preferably secured to skiboard 22 via channel 30 and nuts 120, it is to be appreciated that the present invention encompasses alternative means for securing the bindings at selected positions along the length of the skiboard. For instance, the placement of channel 30 and nuts 120 may be reversed, with elongate channels being provided in bottom layer 132 of footbed 130 and a series of nuts 120 being secured to skiboard 22 along the length thereof. Therefore, it is intended that all matter contained in the above descriptions or shown in the accompanying drawings shall be interpreted in an illustrative and not in a limiting sense.

The embodiments of the invention in which an exclusive property or privilege is claimed are defined as follows:

1. A water sports device for supporting a user towed behind a boat comprising an elongated board adapted to ride along the water, and binding means for restraining a foot of the user on said board in predetermined orientation relative to said board, said binding means including a base member, means for mounting said base member on said board for movement lengthwise of said board, first releasable locking means for selectively stationarily securing said base member to said board in different lengthwise adjusted positions, a base member, means for mounting said footbed member on said base member for rotation relative to said base member for adjustment of the angular orientation of said footbed member relative to said base member and to said board and second releasable mechanical locking means independent of said first locking means for selectively stationarily securing said footbed member to said base member in different rotated positions, said base member mounting means including a first elongated mounting component carried by said board and extending lengthwise thereof and a second mounting component carried by said base member, interfitted with said first mounting component and slidable lengthwise along said first mounting component, said first releasable locking means including means for selectively stationarily securing said base member to said board by selectively preventing relative sliding movement of said first and second mounting components independently of operation of said second releasable locking means.

2. A water sports device for supporting a user towed behind a boat comprising an elongated board adapted to ride along the water, and binding means for restraining a foot of the user on said board in predetermined orientation relative to said board, said binding means including a base member, means for mounting said base member on said board for movement lengthwise of said board, first releasable locking means for selectively stationarily securing said base member to said board in different lengthwise adjusted positions, a footbed member means for mounting said footbed member on said base member for rotation relative to said base member for adjustment of the angular orientation of said footbed member relative to said base member and to said board and second releasable locking means independent of said first locking means for selectively stationarily securing said footbed member to said base member in different rotated positions, said footbed member mounting means mounting said footbed member on said base member for rotation between a first position in which said binding means is oriented for positioning the foot of the user extending substantially lengthwise of said board and a second position in which said binding means is oriented for positioning the foot of the user extending at an angle relative to the length of said board, said second releasable locking means including mechanical actuating means manually operable by the user while being towed for permitting rotation of said footbed member between the first and second positions or for preventing such rotation.

3. A water sports device for supporting a user towed behind a boat comprising an elongated board adapted to ride along the water, and binding means for restraining a foot of the user on said board in predetermined orientation relative to said board, said binding means including a base member, means for mounting said base member on said board in different longitudinal positions, a footbed member, means for mounting said footbed member on said base member for rotation relative to said base member for adjustment of the angular orientation of said footbed member relative to said base member and to said board and mechanical locking means independent of said base member mounting means for selectively stationarily securing said footbed member to said base member in different rotated positions.

4. A water sports device for supporting a user towed behind a boat comprising an elongated board adapted to ride along the water, and binding means for restraining a foot of the user on said board in predetermined orientation relative to said board, said binding means including a footbed member, means for mounting said footbed member on said board for rotation relative to said board to adjust the angular orientation of said footbed member relative to said board and releasable locking means for selectively stationarily securing said footbed member to said board in different rotated positions, said footbed member mounting means permitting rotation of the footbed member between a first position in which said binding means is oriented for positioning the foot of the user extending substantially lengthwise of said board and a second position in which said binding means is oriented for positioning the foot of the user extending at an angle relative to the length of said board, and said releasable locking means including mechanical actuating means manually operable by the user while being towed for permitting rotation of said footbed member between said first and second positions or for preventing such rotation.

5. The method of fixing the position of a rotatable binding on a water skiboard during and following starting of a skier from an in-the-water position to an upright skiing position which comprises orienting the binding so as to position a foot of the skier extending substantially lengthwise of the skiboard, maintaining such lengthwise extending orientation as the skier moves from the in-the-water starting position to the upright skiing position, thereafter rotating the binding to an orientation for positioning the skier's foot at an angle to the length of the skiboard while the skier is in the upright skiing position, and mechanical thereafter securing the binding in the rotated position while the skier is still in the upright skiing position.

* * * * *

UNITED STATES PATENT AND TRADEMARK OFFICE

CERTIFICATE OF CORRECTION

PATENT NO. : 5,277,635

DATED : January 11, 1994

INVENTOR(S) : D. B. Gillis

It is certified that error appears in the above-indentified patent and that said Letters Patent is hereby corrected as shown below:

| COLUMN | LINE | |
|---|---|---|
| Title Page, item | | |
| [56] "U.S. Patents" | 6th Ref. | Please add --4,604,070 8/1986 McKee et al.-- |
| [56] "U.S. Patents" | 7th Ref. | Please add --4,871,337 10/1989 Harris-- |
| [56] "U.S. Patents" | 8th Ref. | Please add --4,964,649 10/1990 Chamberlin-- |
| 3 | 45 | after "binding" delete "baseplate" |
| 3 | 59 | "downward projecting" should read --downward-projecting-- |
| 4 | 49 | "extends as" should read --extends. As-- |
| 4 | 50 | "constructions," should read --construction,-- |
| 8 (Claim 1 | 51 Line 10) | "base" should read --footbed-- |
| 10 | 40 | "mechanical" should read --mechanically-- |

Signed and Sealed this

Twenty-third Day of August, 1994

*Attest:*

Bruce Lehman

BRUCE LEHMAN

*Attesting Officer*

*Commissioner of Patents and Trademarks*